United States Patent [19]

Zingher

[11] 4,332,872

[45] Jun. 1, 1982

[54] OPTICALLY ANNOTATABLE RECORDING FILM

[76] Inventor: Arthur R. Zingher, 40 Winthrop Ave., Elmsford, N.Y. 10523

[21] Appl. No.: 188,858

[22] Filed: Sep. 19, 1980

[51] Int. Cl.[3] ..... G03C 11/00; G03C 11/02

[52] U.S. Cl. ..... 430/8; 430/22; 430/12; 346/76 L; 428/913; 428/199; 428/200; 428/202; 428/204; 428/520; 428/523; 428/522; 353/44; 350/353

[58] Field of Search ..... 428/520, 523, 522, 913, 428/199, 200, 202, 204; 430/1, 22, 8; 346/76 L, 135.1

[56] References Cited

U.S. PATENT DOCUMENTS

| | | | |
|---|---|---|---|
| 3,682,684 | 8/1972 | Newman et al. | 428/913 X |
| 3,843,384 | 10/1974 | Adachi et al. | 428/199 |
| 3,851,948 | 12/1974 | Gange et al. | 430/1 X |
| 4,025,345 | 5/1977 | Kido et al. | 430/1 |
| 4,076,371 | 2/1978 | Braun et al. | 430/1 |
| 4,118,229 | 10/1978 | Stromberger | 430/1 |
| 4,191,457 | 3/1980 | Zingher | 430/1 X |
| 4,199,615 | 4/1980 | Wacks et al. | 428/913 |
| 4,214,249 | 7/1980 | Kasai et al. | 428/199 |

FOREIGN PATENT DOCUMENTS

| | | | |
|---|---|---|---|
| 51-25478 | 7/1976 | Japan | 428/202 |
| 54-9059 | 4/1979 | Japan | 428/522 |
| 55-5437 | 2/1980 | Japan | 428/520 |

*Primary Examiner*—P. Ives

*Attorney, Agent, or Firm*—Harris Zimmerman; Howard Cohen

[57] ABSTRACT

In a device for projecting a primary image from a transparency along an optical path and for altering the image by selectively directing a writing light source reversably along the optical path toward the transparency, a transparent recording film includes a pre-recorded primary image layer and a secondary layer annotatable by the marking light. The two layers are congruent, and in one embodiment comprise superimposed substrates which are joined mechanically. In another embodiment, the two layers are coated jointly on one substrate, and in a further embodiment the two layers are intimately mixed to form one bifunctional layer. Various means are disclosed whereby the primary image layer is unaffected by the marking light, and the annotatable secondary layer is unaffected by the projection illumination.

15 Claims, 4 Drawing Figures

OPTICALLY ANNOTATABLE RECORDING FILM

BACKGROUND OF THE INVENTION

U.S. Pat. No. 4,191,457, issued Mar. 4, 1980 to Arthur R. Zingher, discloses an apparatus for selectively annotating an optically projected transparency by means of a writing light which is directed at the apparent projected image, through the projection optics, and focussed directly adjacent to the transparency. The present invention is directed toward an annotatable recording film which may be used in this apparatus.

The following U.S. Pat. Nos. comprise the closest known prior art: 4,133,688; 4,127,322; 3,684,552; 3,682,684; 3,852,093; 3,843,384; 4,121,196; 4,000,945; 3,892,965; 3,664,858; 3,592,528.

These prior art references disclose various component technologies in which images are formed by thermographic or photochemical processes. None of these references disclose a film which can be utilized in the apparatus for annotating an optically projected transparency.

SUMMARY OF THE PRESENT INVENTION

The present invention is directed toward a film structure adapted for use in a bi-directional optical apparatus for optically annotating an image projected from a transparency. The film structure includes a primary layer on which a primary image is prerecorded, as well as a secondary layer which is selectively annotatable by means of a marking light which is directed reversably through the projection optics to impinge upon the secondary layer. In one embodiment, the primary layer is a film substrate on which is coated a photochemical emulsion, while the secondary layer includes a thermographic substance which is selectively responsive to the marking light. The two layers are congruent, and may be joined to separate substrates which are mechanically joined by adhesive or mechanical means. In an alternative embodiment, the two layers are coated on opposite sides of a single substrate. In a further embodiment the primary and secondary layers are intimately mixed in a single bifunctional structure. A salient feature of the present invention is that the primary layer, on which the primary image is pre-recorded, is unaffected by the marking light, whereas the secondary layer, which is selectively annotatable by the marking light, is unaffected by the projection illumination. The marking light causes a virtually instantaneous reaction in the secondary layer, the reaction creating a localized change in the transparency or color of the secondary layer. As a result, the projected image, which is a combination of the pre-recorded primary image and the annotated secondary image, is likewise altered virtually instantaneously. Thus an individual viewing the projected combined image may selectively direct the marking light at portions of the image to alter the informational content of the image.

The primary and secondary images may comprise positive images or negative images in complementary colors, so that the primary information and the secondarily annotated information in the combined image may be distinguished. In an alternative embodiment a bi-functional layer contains both primary and secondary image recording substances which are intimately intermixed. A primary image may be pre-recorded in the bi-functional layer, with the marking light causing localized discoloration or bleaching of the primary image during secondary annotation thereof.

A BRIEF DESCRIPTION OF THE DRAWING

DESCRIPTION OF THE PREFERRED EMBODIMENT

The present invention generally comprises a film transparency structure for use in a bi-directional optical apparatus which projects an image from the transparency and also permits selective annotation of the projected image. The projection apparatus is disclosed in U.S. Pat. No. 4,191,457, issued Mar. 4, 1980; that disclosure is hereby incorporated by reference in the present description.

Figure 1:
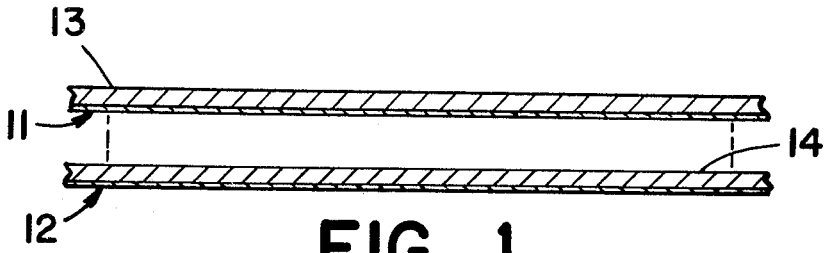
FIG. 1 is a cross-sectional elevation of one embodiment of the film structure of the present invention.

With reference to FIG. 1, one embodiment of the film structure of the present invention includes a primary substrate 11 and a secondary substrate 12. Adhering to the primary substrate 11 is a primary image storing layer 13. Likewise, a secondary image recording layer 14 is secured to the secondary substrate 12. The primary image recording layer is generally pre-recorded prior to use of the film structure in an image annotating apparatus. The pre-recording of the primary image may be accomplished by photographic or electrographic techniques. The secondary image recording layer 14 is generally not pre-recorded, but is adapted to be annotated by use of the marking light of the bi-directional apparatus which projects the image stored in the primary layer 13.

The image stored in the primary layer 13 may be recorded by a photochemical reaction in which a full image frame is recorded at once. For example, the layer 13 may comprise a silver halide emulsion which is exposed to the primary image and then developed and fixed with a thiosulfate process known in the prior art. Alternatively, the primary layer 13 may comprise a static charge storing compound which is photoelectrically or photoconductively exposed to the primary image, and subsequently fixed using electrophotographic techniques known in the prior art. The charge carrying surface may be the layer 13 itself or another surface which transfers the primary image to the layer 13 during the electrophotographic process.

The primary image may be formed upon the primary layer 13 by direct printing or embossing thereon through direct mechanical contact, or by the use of ink jet printing techniques, or the like. Other means of forming the primary image in the primary layer 13 include intense, directed local radiation such as various diazo processes known in the prior art. Likewise, thermographic, pyrographic, or lasergraphic processes may be used to create the primary image in the primary layer 13. For some of these image forming processes, the primary layer 13 may comprise the primary substrate itself.

The secondary layer 14 is adapted to record and display immediately annotations to the primary image which are created by a brief exposure of the secondary layer 14 to the marking light of the bi-directional projection and annotation apparatus. The secondary image must appear immediately after exposure, without a macroscopic interruption for development of the secondary image, so that the primary image may be annotated and viewed in a real time process. In one embodiment, the secondary layer 14 comprises polyvinyl chloride which is coated or intermixed with iron acetyl acetonate. The iron acetyl acetonate absorbs the marking light of the annotation apparatus, causing localized heating in the layer 14. The localized heating of the polyvinyl chloride produces a visible char which is much more opaque than the polyvinyl chloride layer.

Alternatively, the secondary imaging layer 14 may include a substance such as lead dithioformate. When the lead diothioformate is illuminated by the marking light, it undergoes a thermographic monomolecular decomposition. Upon decomposing, it deposits black lead sulfide, creating a localized opacity in the secondary layer. Monomolecular reactions such as this thermographic decomposition are advantageous in that they exhibit a fast microscopic initiation speed. Hence they are particularly suitable for pulsed marking light sources, such as pulsed lasers.

In another embodiment, the secondary layer 14 may include a meltable binder material in which a silver salt is intermixed with soap granules. Impingement of the marking light upon the secondary layer causes a thermographic biomolecular reaction in which melting and diffusion takes place in the binder in the localized area where the silver salt absorbs the marking light. The localized heating caused by the silver salt reacting to the marking light creates a localized melting zone in which the soap granules diffuse, thus altering the light transmitting characteristics thereof.

In a further embodiment, the secondary layer 14 may comprise a transparent plastic material which includes an infrared light absorbing dye. For this embodiment the projection and annotating apparatus includes an infrared marking light which is absorbed by the dye in the secondary layer. When sufficient infrared energy is absorbed by the dye in a localized area, the layer 14 melts. After the marking light illumination terminates, or translates to another part of the secondary layer, the melted zone resolidifies with an irregular optical texture. The irregular optical texture may be enhanced by the optical arrangement of the projection apparatus; for example, by the use of polarizing filters or Schlieren optics, or the like.

It may be appreciated that any of the embodiments of the secondary layer may be combined advantageously with any of the embodiments of the primary layer. The two layers must be congruent and closely adjacent so that their respective images will be superimposed by the projection illumination. The secondary substrate 12 may be joined to the primary substrate 11 by means of an adhesive layer having a peelable backing layer. Thus, the backing layer could be removed to expose the adhesive layer, and the secondary substrate could then be adhered to the primary substrate. This structure is useful for retrofitting pre-exisiting microfiche or microcard records. It may be appreciated that the secondary image could be separated and removed from the primary substrate, so that the annotations to the primary image could be renewed or replaced by the addition of another secondary structure. The two substrates 11 and 12 may also be joined by more permanent mechanical means, such as adhesive, tape, ultrasonic or thermal plastic welding, staples, rivets, and the like. In these latter examples it is apparent that the secondary, annotating image could not easily be renewed or replaced.

Figure 2:
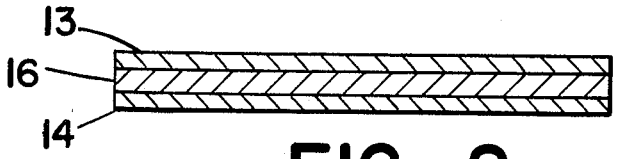
FIG. 2 is a cross-sectional elevation of a further embodiment of the film structure of the present invention.

With reference to FIG. 2, a further embodiment of the present invention includes a unitary substrate 16 on which the primary layer 13 and the secondary layer 14 are coated on opposite sides thereof. The secondary layer 14 may be secured to the substrate 16 after the image recorded in the primary layer 13 is developed or otherwise fixed, according to the image recording process embodied therein. The primary and secondary layers are applied to opposed sides of substrate 16 to minimize any adverse chemical reaction that may take place therebetween. The primary and secondary layers 13 and 14 may embody any of the image recording process described with reference to the previous embodiment. The embodiment of FIG. 2 may be adapted for use with computer output micrographic systems by the addition thereto of a device which applies the secondary layer 14 to the micrographic output film after an image has been recorded thereon by any of the computer output micrographic (COM) systems known in the prior art.

In the embodiments shown in FIGS. 1 and 2, it is advantageous for the secondary layer to be disposed nearer to viewing screen, and the primary layer farther from the viewing screen, so that the opaque areas of the primary image do not prevent the marking light from impinging upon the secondary layer.

Figure 4:
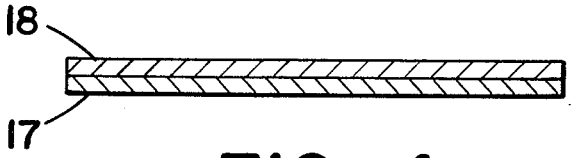
FIG. 4 is a cross-sectional elevation of another embodiment of the film structure of the present invention.

With reference to FIG. 4, a further embodiment of the film structure of the present invention includes a substrate 17 and a bifunctional layer 18 adhered to one surface of the substrate. The bifunctional layer includes primary and secondary components intimately combined, so that the primary image and the annotated secondary image may be formed within the single layer 18. For example, the primary image recording component may comprise standard silver halide photochemistry, with the addition of an extra infrared light selective absorber in the developed emulsion. After the primary image has been exposed and developed, it may be annotated pyrographically by localized absorption of an infrared marking light which is matched in wave length to the band width of the infrared absorber in the layer 18.

Alternatively, the embodiment of FIG. 4 may form the secondary image by means of a thermographic binary chemical reaction between the primary and secondary components. The primary image may be formed photochemically or electrostatically using a primary image pigment or dye which is subject to chemical discoloration or chemical bleaching. Dispersed in the layer 18 are fine grains or coated microspheres of a meltable solid in which are embedded a suitable bleaching compound and a selective infrared light absorbing compound. When the marking light impinges upon the selective infrared absorber, it causes localized heating which melts the solid material in the grains or microspheres and causes release of the bleaching compound in the localized, melted area. The bleaching compound discolors the primary image in the localized area, thus altering the informational content thereof.

As another alternative, the embodiment of FIG. 4 may include in the layer 18 a primary image pigment or dye which is subject to radiant bleaching action by the secondary marking light. For example, most dyes are faded or deteriorated by exposure to ultraviolet light. Assuming that the projection and annotating apparatus provides an ultraviolet marking light, the marking light may radiantly bleach the dye compound which forms the primary image. Due to the fact that this embodiment involves no diffusion or chemical reaction, it exhibits an advantageous microscopic speed.

It is apparent that the superimposed primary and secondary images should be clearly visible and distinguishable. Assuming that transmission images are employed, if both images are positive (dark letters and marks on a light background), then both images will be visible. However, this arrangement is disadvantageous in that a bright background tends to produce eye fatigue in the reader or viewer. If negative superimposed images are used, with transparent letters and marks on separate black backgrounds, the combined image will be dim, low contrast, and difficult to view.

A salient feature of the present invention is the use of complementary colors for the two negative images. For example, the primary image may comprise clear letters on a red transmitting background, while the secondary image comprises clear letters on a green transmitting background. The projected, combined images of the superimposed separate images will show the bright green letters of the primary image and bright red marks of the annotating image against a dark black background. Of course, the optical system of the projection and annotating apparatus will be matched to this two-color system, including the light sources, lenses, mirrors, screen, and anti-ambient filters or coatings.

It may be appreciated that the embodiments of the present invention which employ bleaching, bifunctional bleaching, or discoloration do not require the use of complementary colors for the separate images. The process of recording the secondary image by bleaching or discoloration creates a clear spot in an otherwise absorbing primary background. Thus both the primary letters and the secondary marks will be projected as bright picture elements on a dark background.

It may be appreciated that the secondary image forming component of the film structure must be sensitive to a brief illumination by the marking light, while being insensitive to prolonged exposure to the projection illumination. Fortunately, many thermographic melting processes known in the prior art exhibit a sharply defined transition temperature. They respond to momentary intense local heating, but are unaffected by prolonged illumination at sub-threshhold temperatures. Therefore the secondary image forming component easily may be made to distinguish between the intense marking light illumination and the steady but much less intense projection illumination.

Indeed, the projection illumination acts synergistically to facilitate secondary annotation of the film structure. In a typical microfiche reader, the film is heated to approximately 160° Fahrenheit by the projection illumination, despite the use of infrared squelching filters in the projection light collimator source. This preheating of the film assists most secondary recording process described in the foregoing, and permits a more reliable annotation with a less powerful marking light. Since a typical thermographic secondary image forming process exhibits a transition temperature of 175° Fahrenheit, the marking light is required to heat the localized area of the secondary layer by an increment of 15° Fahrenheit. Without the preheating of the film by the projection illumination, the marking light would be required to heat the localized area of the secondary layer from room temperature (approximately 65° Fahrenheit) to the transition temperature of 175° Fahrenheit, an increment of 110° Fahrenheit. This far larger increment would necessitate a much more intense marking light, a requirement that is obviated synergistically by the heating effect of the projection illumination.

Figure 3:
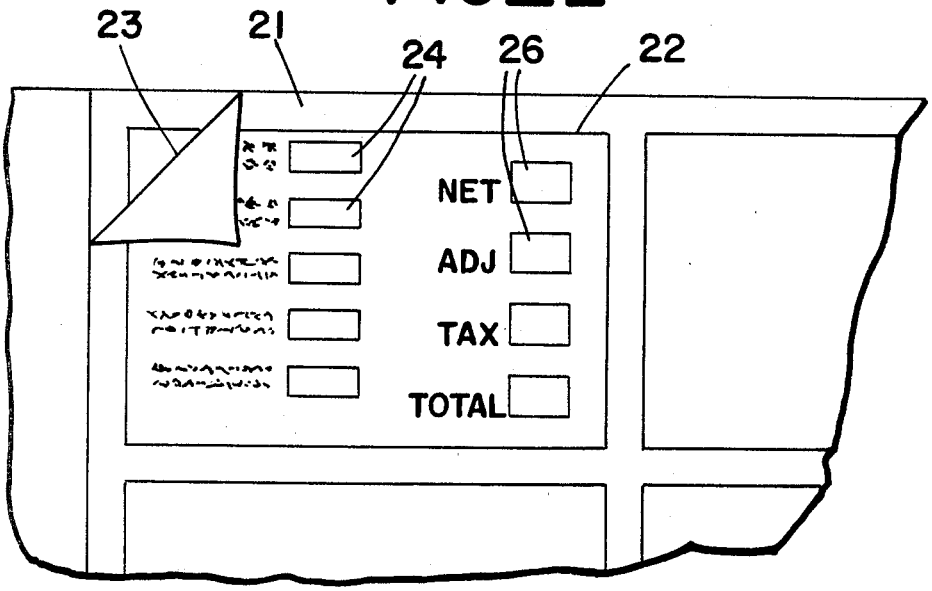
FIG. 3 is a partial plan view of one adaptation of the embodiment shown in FIG. 1.

The film structure of the present invention is also uniquely adaptable as a computer input micrographic (CIM) medium. With reference to FIG. 3, a microfiche field 21 includes one or more frames 22. The frames 22 are provided with primary images which catalog a large amount of data; for example, replacement parts for appliances and other items sold by a retail outlet, or inventory records of an automotive parts department in a franchise dealership. Adhered to the microfiche field 21 is an overlay 23 which is releasably secured to the microfiche card. The overlay 23 includes defined response areas 24 and 26 in which secondary image forming components are disposed. To order parts or the like from the microfiche catalog, the operator or dealer uses the marking light of the annotating apparatus to mark the proper response areas 24 and 26. The microfiche card may then be sent to a central warehouse or other processing area where the overlay 23 is removed and scanned by a suitably adapted computer. A new overlay 23 may then be applied to the field 21 of the microfiche card, which is then returned to the dealer for reuse. This system avoids the errors often incurred in copying part numbers and quantities or in making adequate parts descriptions on order forms. The primary micrographic images are very economical in displaying large amounts of customized data, even on a one-of-a-kind basis.

The defined response zones 24 and 26 prevent stray markings on the overlay 23 which might cause errors in the machine reading of the order form. Machine reading of the order form may be facilitated by use of the two color complementary system described in the foregoing, since the annotation may be automatically separated from any primary image by suitable filters. This computer input micrographic system also offers distinct advantages over computer terminal systems in low-cost applications. For example, detailed diagrams which often accompany component lists and the like require a very high quality computer graphical terminal, in addition to a large amount of electronic storage. For this type of application, the CIM system described herein is much more economical.

I claim:

1. A microfiche film structure for use in a bi-directional microfiche apparatus which projects an image from said film structure and which also includes a laser marking light source for optically annotating said image, including: a primary image recording medium for photographically forming and photochemically fixing a primary image in said film structure; a secondary image recording medium of a separate and distinct character from said primary image recording medium, said secondary image recording medium being disposed in said film structure and being responsive to said laser marking light to record annotations to said primary image, said annotations being recorded in congruent, overlying registration with said primary image.

2. The film structure of claim 1, wherein said secondary image recording medium includes a pyrographic compound adapted to produce localized opaque annotating marks upon receipt of said laser marking light.

3. The film structure of claim 2, wherein said pyrographic compound includes a layer of iron acetyl acetonate coated on a layer of polyvinyl chloride.

4. The film structure of claim 1 wherein said secondary image recording medium comprises a thermographic monomolecular compound adapted for decomposing and forming localized opaque annotating marks upon illumination by said laser marking light.

5. The film structure of claim 4, wherein said compound includes lead dithioformate.

6. The film structure of claim 1, wherein said secondary image recording medium includes a thermographic bimolecular compound adapted for reacting to said laser marking light to produce localized opaque annotating marks.

7. The film structure of claim 6, wherein said biomolecular compound includes a silver salt and granules of soap intermixed in a binder compound which is adapted to be melted by said laser marking light.

8. The film structure of claim 1, wherein said secondary image recording medium includes a thermographic compound adapted for melting upon illumination by said laser marking light to form localized opaque annotating marks.

9. The film structure of claim 8, wherein said thermographic compound includes a transparent compound forming a layer in said film structure and an infra-red wavelength absorbing dye dispersed in said transparent compound.

10. The film structure of claim 1, wherein said primary image recording medium and said secondary image recording medium are adhered to opposed sides of said film structure.

11. The film structure of claim 1, wherein said primary image recording medium provides transparent marking portions on a translucent field having a first field color, said secondary image recording medium providing transparent marking portions on a translucent field having a second field color, said first and second field colors being complementary.

12. The film structure of claim 1, wherein said primary image recording medium comprises a first transparency having a primary image prerecorded thereon.

13. The film structure of claim 12, further including a second transparency mechanically joined to said first transparency and incorporating said secondary image recording medium therein.

14. The film structure of claim 13, wherein said secondary image recording medium is confined to defined response zones occupying selected portions of said second transparency, said defined response zones being aligned in registration with selected portions of said primary image.

15. The film structure of claim 13, wherein said second transparency is selectively removable from said first transparency.

* * * * *